US005907871A

United States Patent [19]

Austin

[11] Patent Number: 5,907,871

[45] Date of Patent: Jun. 1, 1999

[54] COMBINED CAP AND BALL GLOVE

[76] Inventor: Michael B. Austin, 5180 Mussellshell Rd., Custer, Mont. 59024

[21] Appl. No.: 08/992,402

[22] Filed: Dec. 17, 1997

Related U.S. Application Data

[63] Continuation-in-part of application No. 08/730,490, Oct. 11, 1996, abandoned.

[51] Int. Cl.[6] ..... A42B 1/06

[52] U.S. Cl. ..... 2/209.12; 2/19; 2/181; 2/183; 2/195.1; 2/195.3; 2/209.7

[58] Field of Search ..... 2/19, 161.1, 181, 2/182.1, 183, 195.1, 195.2, 195.3, 209.11, 209.12, 209.13, 209.7

[56] References Cited

U.S. PATENT DOCUMENTS

| | | |
|---|---|---|
| 133,689 | 12/1872 | Whitaker . |
| D. 285,141 | 8/1986 | Whisman . |
| D. 339,668 | 9/1993 | Ochs . |
| D. 355,976 | 3/1995 | Gilfert et al. . |
| 373,048 | 11/1887 | Burr . |
| 789,480 | 5/1905 | Bennett . |
| 1,057,204 | 3/1913 | Yudelson . |
| 1,161,637 | 11/1915 | Dunn . |
| 1,496,330 | 6/1924 | Tollefson . |
| 1,664,255 | 3/1928 | Lesser . |
| 1,810,655 | 6/1931 | Hosking . |
| 1,869,652 | 8/1932 | Baker . |
| 1,974,616 | 9/1934 | Kirkham . |
| 2,007,235 | 7/1935 | Woodside . |
| 2,013,245 | 9/1935 | Lewis . |
| 2,333,987 | 11/1943 | Dandy . |
| 2,420,569 | 5/1947 | Sewell . |
| 2,434,170 | 1/1948 | Latina . |
| 2,615,168 | 10/1952 | Tannenbaum . |
| 2,688,204 | 9/1954 | Laubhan . |
| 2,710,973 | 6/1955 | Feldman . |
| 2,744,256 | 5/1956 | Slotkin et al. . |
| 2,794,189 | 6/1957 | Nesbit et al. . |
| 3,085,252 | 4/1963 | Smith . |
| 4,165,542 | 8/1979 | McLaughlin . |
| 4,312,076 | 1/1982 | Gamm . |
| 4,386,437 | 6/1983 | Fosher . |
| 4,451,935 | 6/1984 | Henschel . |
| 4,472,837 | 9/1984 | Saxton . |
| 4,628,543 | 12/1986 | Hunt . |
| 4,768,232 | 9/1988 | Villalobos . |
| 4,829,600 | 5/1989 | Courtney . |
| 5,107,548 | 4/1992 | Dotzenrod . |
| 5,542,129 | 8/1996 | Munoz . |
| 5,615,415 | 4/1997 | Beckerman . |

*Primary Examiner*—Diana L. Biefeld
*Attorney, Agent, or Firm*—Swanson & Bratschun LLC

[57] ABSTRACT

A combination cap/glove selectively usable as a cap worn on a person's head and a glove worn on a person's hand for catching a ball. The cap/glove includes a concave crown having a peripheral bottom edge, an interior surface and an exterior surface. A hand receptacle having an opening is mounted to a first side of the crown. A band of flexible sheet material having a top and a bottom edge is attached by the bottom edge of the band to the interior surface of the crown at a second side of the crown substantially opposite the first side of the crown. The band is attached to the crown in a manner biasing the top edge of the band away from the crown interior to define a ball catching pocket opposite the hand receptacle.

17 Claims, 6 Drawing Sheets

COMBINED CAP AND BALL GLOVE

This application is a continuation-in-part of U.S. application Ser. No. 08/730,490, filed on Oct. 11, 1996.

BACKGROUND OF THE INVENTION

1. Technical Field

The present invention is generally directed toward sports head wear, and more particularly toward a combination cap/glove for selective use as a cap for covering a user's head and a glove for catching a ball.

2. Background Art

Baseball caps have been around for many years and traditionally consist of four to six triangular shaped sections sewn together so that a point of each triangle meets at the center, or apex of a crown. A stiff brim or visor is sewn to a peripheral portion of the crown. Such baseball caps have been worn for years by baseball players and spectators at baseball games. The caps often bear a logo of the player's team or the spectator's preferred team and function both to demonstrate allegiance with a team and to shade the user's eyes from the sun.

Baseball gloves have also been associated with the game of baseball for many years. Baseball gloves are used by fielders to assist in catching baseballs. In addition, it is a common practice for spectators to bring baseball gloves to baseball games in order to catch baseballs that are hit into the stands. One problem with baseball gloves is that they are heavy and awkward when worn continuously on a spectator's hand and must also be removed during eating or whenever two hands are required. Thus, baseball gloves can be easily lost at baseball games because of the need to remove the baseball glove from time to time. Furthermore, because a ball may be struck into the stands at any time, a spectator who has momentarily removed a glove may not be able to quickly locate and deploy the glove in order to catch a baseball.

There has long been a need to combine the convenience of a baseball cap with the protection of a baseball glove and such cap/gloves have been the subject of at least two prior art patents, Villalobos, U.S. Pat. No. 4,768,232 and Hunt, U.S. Pat. No. 4,628,543. Villalobos discloses a cap comprising a concave crown formed of a flexible sheet having a brim formed of a stiffener covered with a flexible sheet material attached to a peripheral edge of the crown. A mit is attached to an outer surface of the crown for receiving a person's hand so that the interior of the crown can be positioned by a hand received in the mit to capture a flying object such as a baseball. Villalobos further teaches providing a pad between the mit and the interior of the crown for protecting a user's hand while catching an object. Villalobos also teaches that the mit is positioned on the crown above the brim with the opening of the mit where the peripheral edge of the crown meets the brim. Villalobos teaches an elastic band attached along the opening of the mit to aid in holding the cap in place on a user's hand.

Villalobos is clearly an improvement over the use of the standard baseball cap for catching baseballs. However, Villalobos still has several serious defects. First, Villalobos relies primarily on the interior of the crown to capture a baseball. If a user does not successfully position the baseball over the user's palm when using the Villalobos glove/cap and the ball is received in the crown above the user's hand, the ball is likely to bounce out of the interior of the cap before the user can retrieve it. In addition, if the user is successful in guiding the mit portion of the crown to the baseball, the padding is insufficient to provide true protection for the hand and a possibility of serious injury to the user's hand is presented. Furthermore, the cap/glove of Villalobos teaches an access to the mit at the intersection of the crown and brim where it can be difficult for a user to quickly insert his hand under the elastic strip. Thus, Villalobos can be difficult to deploy in the few seconds a fan has to react and to catch a ball. Finally, Villalobos teaches a mit on an outer surface of a cap which has an unsightly appearance and could deter fashion conscious sports fans from using an otherwise potentially useful article.

Hunt teaches a cap/glove including a crown portion having a material liner on an interior portion of the crown defining a pocket for accommodating a user's hand therein. The pocket has an opening at the rear of the cap for receiving the user's hand. Hunt further teaches providing a protective pad between the interior of the crown and the glove.

The structure of Hunt has additional deficiencies to those mentioned above with regard to Villalobos. In particular, Hunt teaches only that the glove is accessible from the back of the cap. Thus, the cap/glove of Hunt can not be quickly deployed as a glove. Furthermore, Hunt does nothing to overcome the problems with retaining a ball in the interior of the crown during the catching of a ball as discussed above with regard to Villalobos.

The present invention is directed toward overcoming one or more of the problems discussed above.

SUMMARY OF THE INVENTION

The present invention is directed toward a combination cap/glove selectively usable as a cap worn on a person's head and a glove worn on a person's hand for catching a ball. The cap/glove includes a concave crown having a peripheral bottom edge, an interior surface and an exterior surface. A hand receptacle having an opening is mounted to a first side of the crown. A band of flexible sheet material having a top and a bottom edge is attached at the bottom edge of the band to the interior surface of the crown at a second side of the crown substantially opposite the first side of the crown. The band is attached in a manner biasing the top edge of the band away from the crown interior to provide a ball catching pocket opposite the hand receptacle.

The hand receptacle may consist of a flexible material liner attached to an interior surface of the crown forming a cavity between the crown interior and the liner and at least one slot through the crown into the cavity for receiving appendages, such as a thumb or fingers, of a user's hand. A flap of flexible material having an opening proximate the appendage receiving slots can be provided on the crown for covering the at least one slot on the outer surface on the crown. Preferably, the flap of flexible material is triangular in shape with a permanent attachment for a first point of the triangle proximate the apex of the crown and elastic straps between the second and third points of the triangle proximate the peripheral bottom edge of the crown to facilitate easy insertion of a hand between the flap and the exterior surface of the crown.

The cap/glove of the present invention is easily manufactured from readily available materials. The cap/glove is both comfortable and indistinguishable from a regular baseball cap, yet provides a safe and effective glove for catching a baseball. The hand receptacle is conveniently located on the front of the ball cap for quick and easy access by a user's hand. A ball received in the crown portion of the cap is trapped to ensure retrieval of the ball.

DETAILED DESCRIPTION OF THE PREFERRED EMBODIMENT

Figure 1:
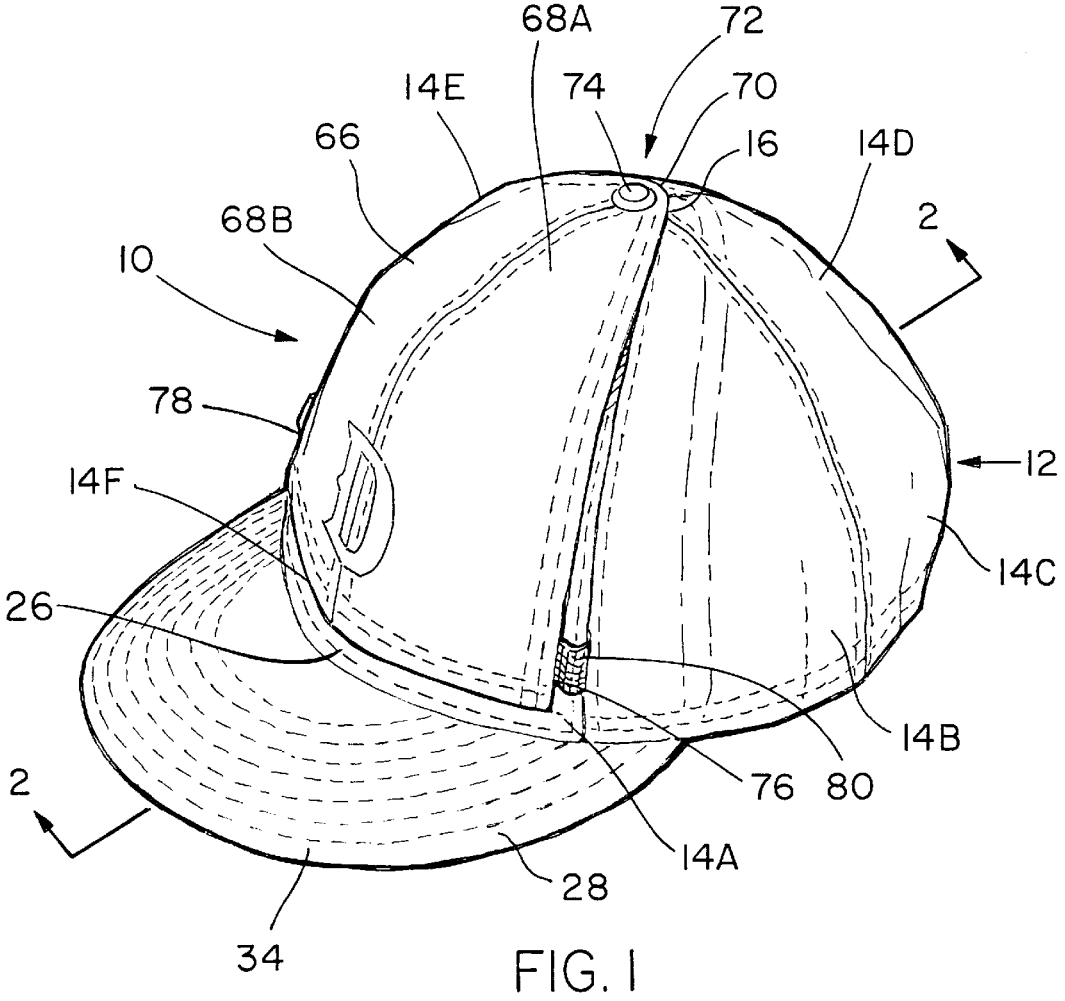
FIG. 1 is a perspective view of a combination cap/glove in accordance with the present invention.
Figure 2:
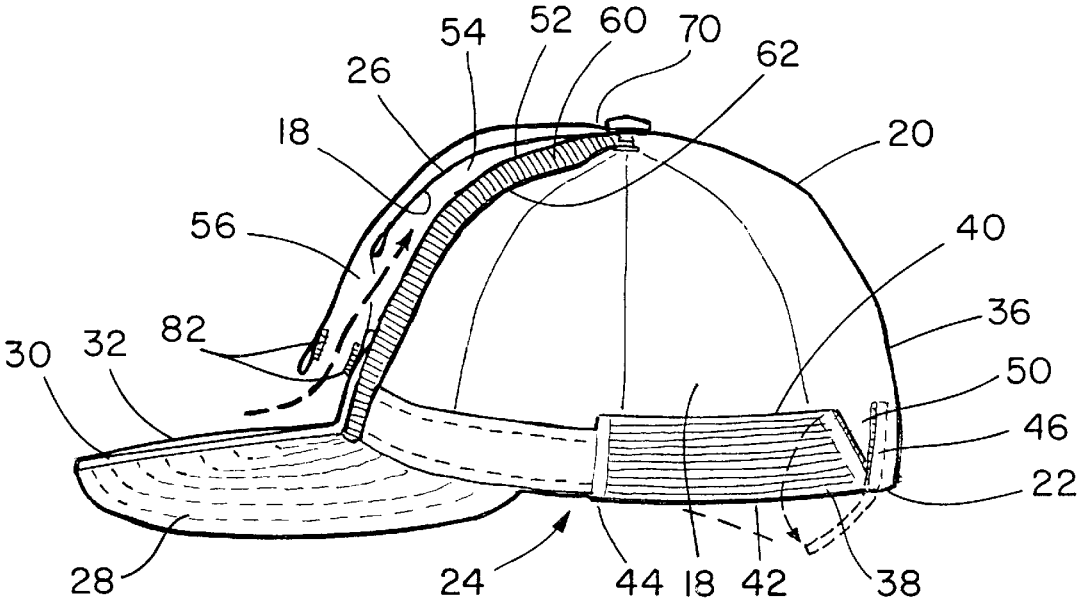
FIG. 2 is a cross sectional side view taken along lines 2—2 of FIG. 1.

FIG. 1 is a perspective view of the combination cap/glove 10 of the present invention. The cap/glove 10 consists of a concave-shaped crown 12 made of six triangular panels of flexible sheet material 14A–F joined at a common first point or apex 16 and stitched to adjacent triangular panels. The concave shaped crown 12 has an interior surface 18, an exterior surface 20 and a peripheral bottom edge 22 defining a cap opening 24. The crown has a front 26 to which a brim or visor 28 is joined about the peripheral bottom edge 22. The brim 28 includes a stiffener 30 covered with a flexible sheet material 32 which is preferably identical to the flexible sheet material making up the triangular panels 14A–F. Stitching 34 binds the flexible sheet material 32 to the stiffener 30. The brim 28 is preferably stitched to the crown 12. At the back 36 of the interior surface 18 of the crown 12 is an elastic strip or band 38. The elastic band 38 has a top edge 40 and a bottom edge 42 and is attached to the peripheral bottom edge 22 of the back 36 of the crown 12 by stitching or the like. Each end of the band 38 is also stitched to the interior surface as illustrated at 44 in FIG. 2. At the back 36 of the crown 12, a pair of V-shaped pieces (only one shown, 46), reside between the interior surface 18 of the crown 12 and the elastic band 38 with the bottom of the V adjacent the bottom edge 42 of the elastic band 38 and the peripheral bottom edge 22 of the crown 20, as best seen in FIG. 2. The V-shaped pieces 46 may be flat plastic strips bent in the middle in the shape of a V or an elastomeric, cylindrical length of garment piping bent in the middle in the shape of a V. These specific embodiments and alternative structures are collectively referred to as "V-shaped plastic strips" herein. One length of each of the V-shaped plastic strips 46 is attached to the interior surface 18 of the crown 12 and the other length is attached to the elastic band 38 by adhesive, stitching, solvent bonding or the like. The V-shaped plastic strips 46 bias the top edge 40 of the elastic band 38 away from the interior surface 18 of the crown to form a pocket 50 between the elastic band 38 and the interior surface 18 of the crown 12. When the cap/glove 10 is worn on a user's head, the V-shaped plastic strips 46 collapse, thereby making the elastic band function and appear like a conventional elastic band on a baseball cap.

Figure 7:
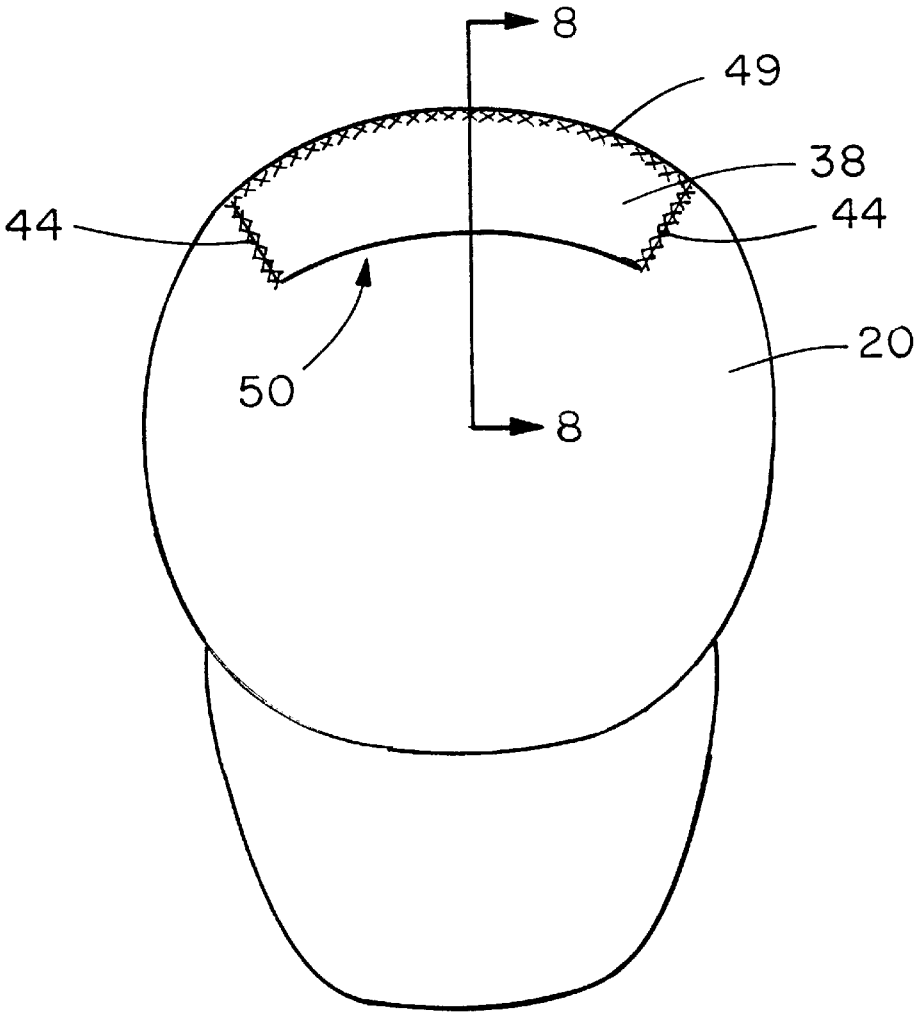
FIG. 7 is a bottom plan view of an alternate embodiment for biasing the top edge of the elastic band inward.
Figure 8:
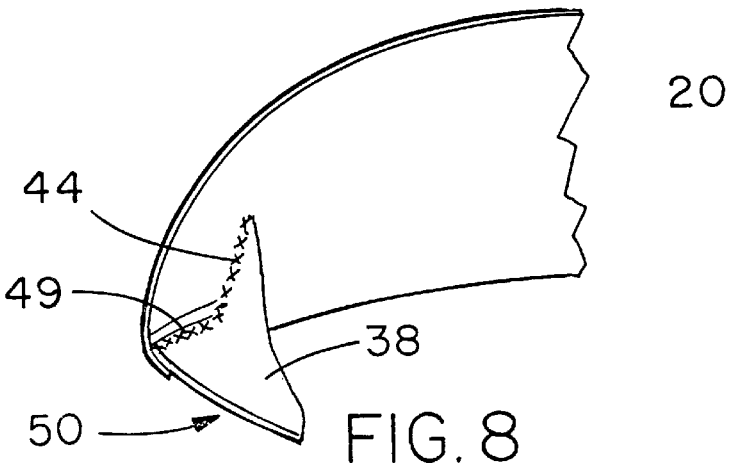
FIG. 8 is a cross sectional view taken along lines 8—8 of FIG. 7.

FIGS. 7 and 8 illustrate an alternate and preferred embodiment for biasing the top edge 40 of the elastic band 38 away from the interior surface 18 of the crown 20. In this embodiment, the bottom edge 42 of the elastic band 38 overlies and is stitched to the peripheral bottom edge 22 of the crown 12, as illustrated at 49. The ends of the band 38 are stitched to the interior as illustrated at 44 in FIGS. 7 and 8. In this manner, the band 38 will be biased outward to define a pocket 50 for receiving a ball. Moreover, the pocket 50 readily collapses when the cap is placed on the head of a user.

Referring to FIG. 2, at the front 26 of the crown 20, a liner 52 made of a flexible material is sewn to the interior surface 18 of the crown 20 forming a cavity 54 between the crown interior surface 18 and the liner 52. A pair of slots 56, 57 (see FIGS. 2 and 3) are cut in the front 26 of the crown 12 to provide access into the cavity 54. Each slot 56, 57 is lined with stitching 58 or edging material to prevent fraying or expansion of the slots 56, 57. Each slot 56, 57 is sized to receive an appendage of a hand such a thumb or several fingers (see FIG. 4). Also attached to the interior surface of the crown 12 adjacent to the liner 52 is a pad 60. The pad 60 is made of a material suitable for cushioning a hand received in the cavity against injury from a baseball or the like caught using the cap and is preferably made from a dense foam rubber, neoprene or the like. A second piece of material liner 62 may be provided between the pad 60 and the crown interior so as to provide a more finished look to the interior of the crown and to enhance the comfort of the cap/glove 10 when worn on a user's head.

Referring to FIGS. 1 and 2, a triangular shaped flap 66 is attached to the front 26 of the crown 12 to cover the slots 56. The triangular shaped flap 66 is preferably made of a pair of triangular panels 68A–B stitched together at adjacent sides so as to resemble a pair of adjacent panels 14A–F of the crown 12. The triangular panel 66 is attached at a top point 70 to the apex 72 of the cap by a rivet 74 which also serves to secure the top point of the triangular panels 14A–F. The second and third points 76,78 are attached to the exterior surface 20 of the front 26 of the crown 12 by elastic straps 80. Intermediate the second and third points 76, 78 a hook and loop fastener 82 such as VELCRO is attached to the exterior surface 20 of the crown 12 and an inner surface of the triangular flap 66 to secure the bottom of the flap 66 to the crown 12 while worn on a user's head, yet to provide a quick release should a user decide to insert his hand between the flap 66 and the crown 20.

Figure 3:
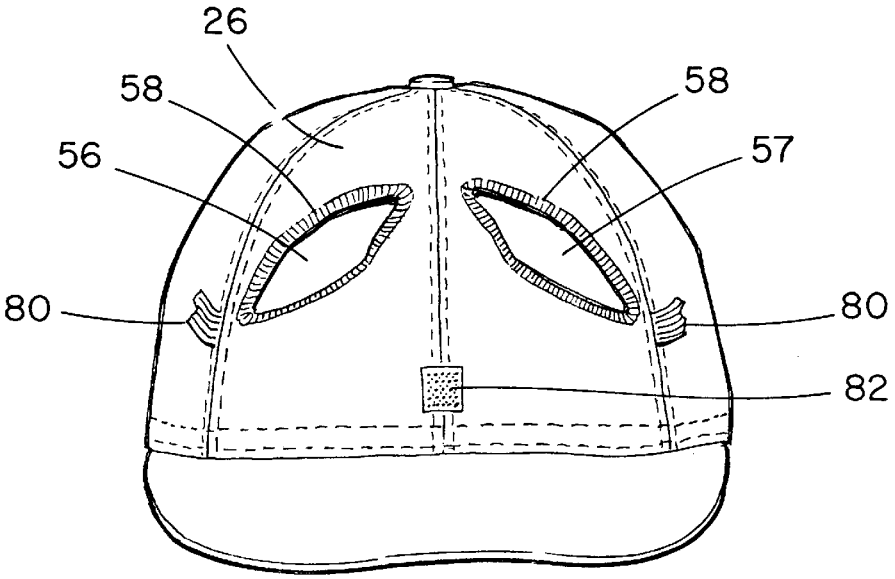
FIG. 3 is a front view of the cap/glove of FIG. 1 with the flap cut away.

In an alternative embodiment illustrated in FIG. 3, an elastic segment or strap 96 extends across the front 26 of the crown 12 in place of the flap 66. The strap 96 is positioned to help secure a user's thumb and fingers in the slots 56, 57.

Figure 4:
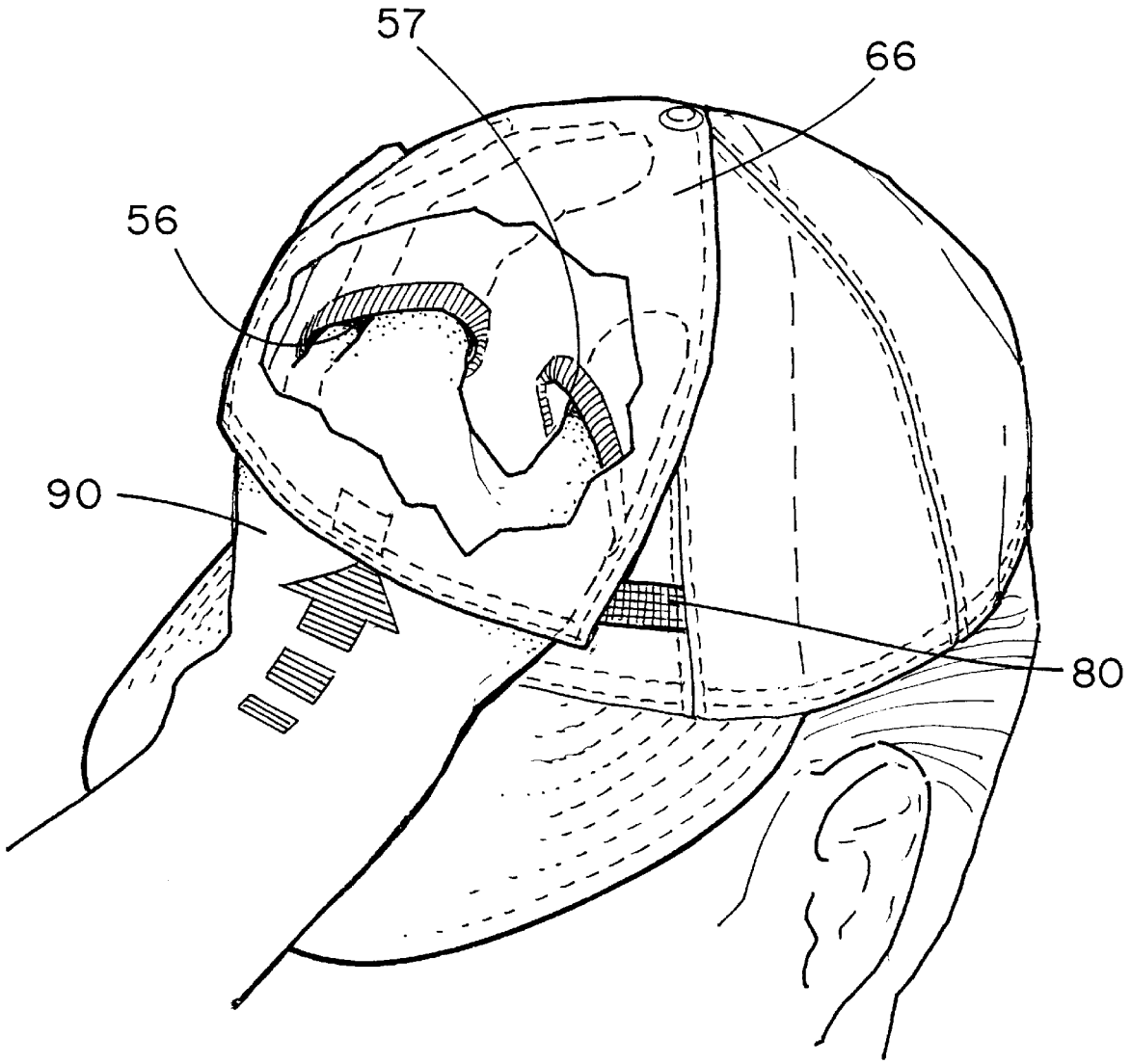
FIG. 4 is a perspective view illustrating deployment of the flow feature of the combination cap/glove of FIG. 1.
Figure 5:
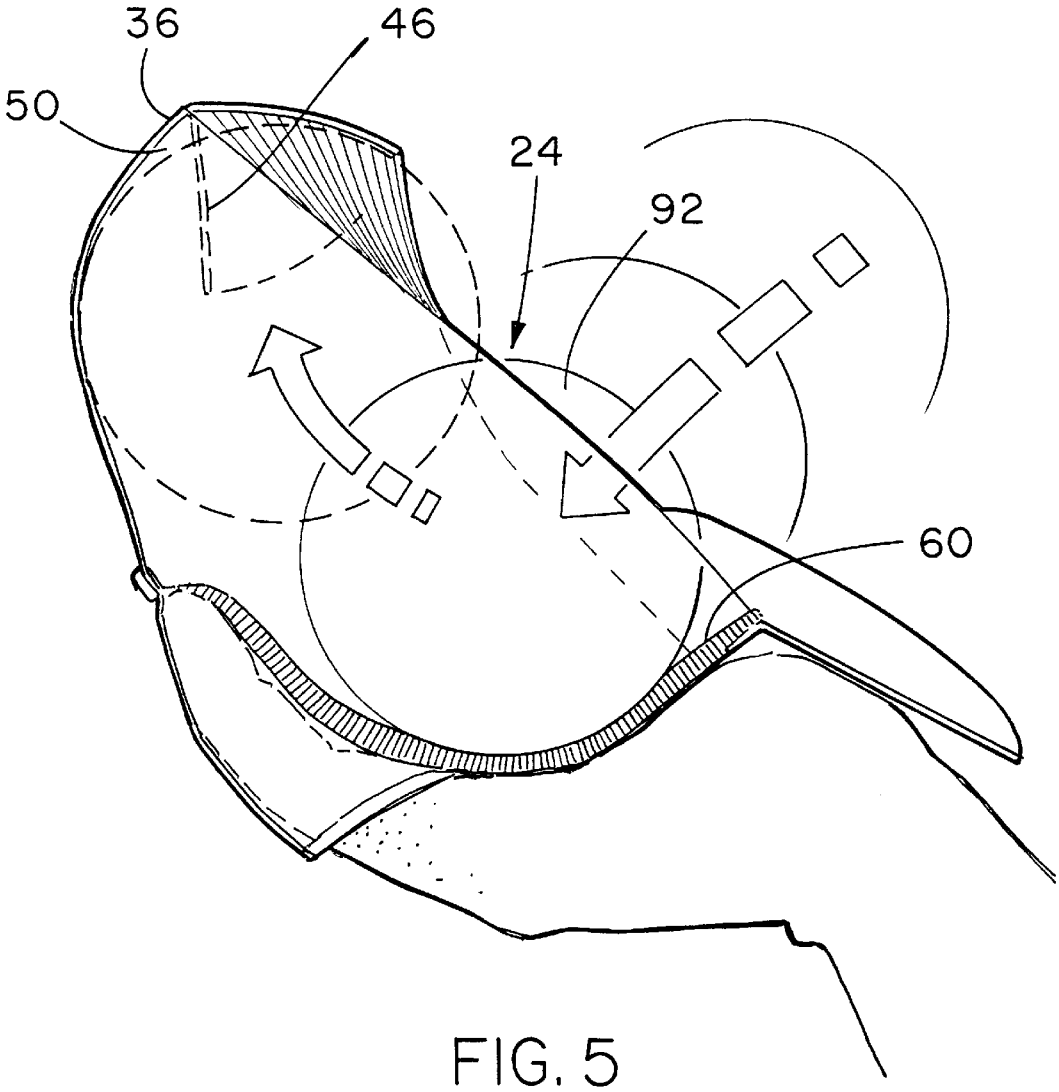
FIG. 5 illustrates the ball catching pocket of the combination cap/glove of FIG. 5.
Figure 6:
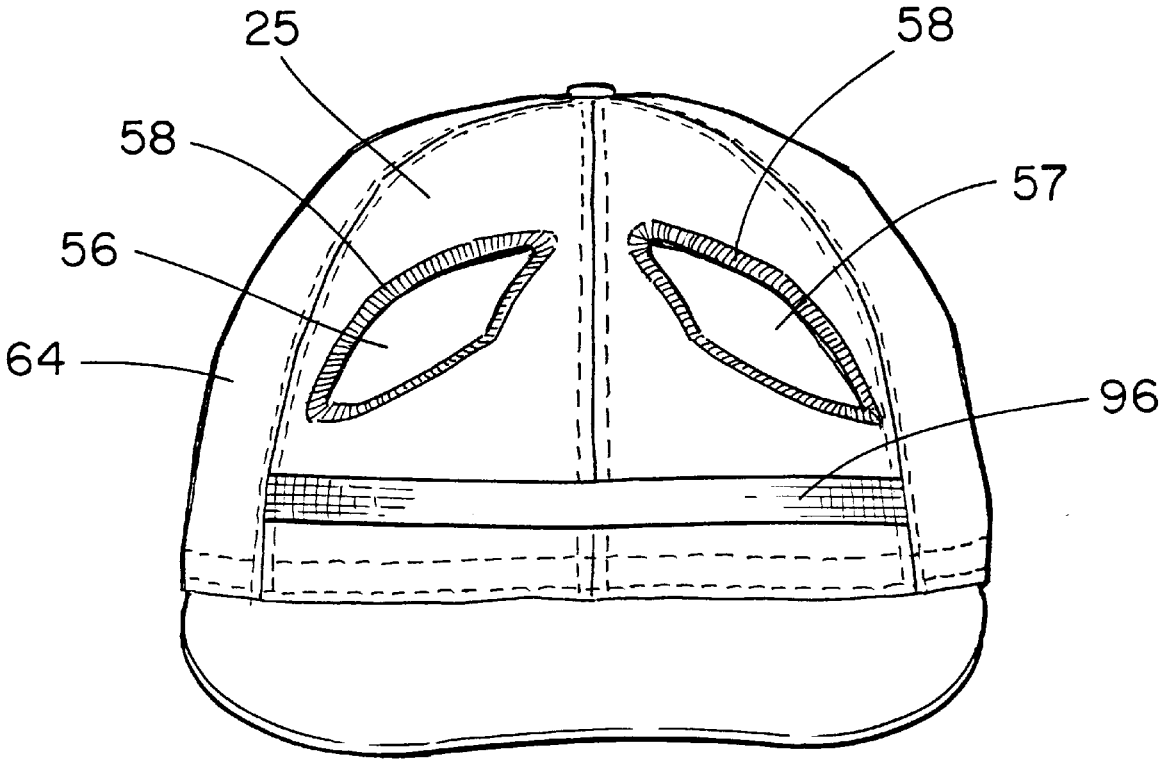
FIG. 6 is an alternate embodiment of the cap/glove.

In use, the cap/glove 10 can be worn on a user's head and because of the unique structure of the triangular shaped flap 66, the cap/glove substantially resembles conventional baseball caps. However, if the user is attending a sporting event such as a baseball game and a ball is hit into the stands in the vicinity of the user, the user can readily deploy the cap/glove as a glove by inserting his hand 90 under the bottom of the flap 66 as best illustrated in FIG. 4. The user may insert either a right or left hand. The slots 56, 57, as discussed above, are sized to fit opposing hand appendages such as a user's thumb and one or more fingers as again illustrated in FIG. 4. With opposing thumb and fingers received in the slots 56, 57, if a ball is hit to the vicinity of the user, the user can grasp the ball with his hand while still being protected by the pad 60. However, the cap provides an additional means for capturing the ball when a user is unable or unwilling to catch the ball between his thumb and fingers. As the ball 92 strikes the pad 60 it is deflected toward the back of the cap 36 and captured by the pocket 50 formed between the elastic band 38 and the cap interior 18 (see FIG. 5). The bias of the V-shaped plastic strips 46 or the stitching illustrated in FIG. 8, keeps the pocket open to receive the baseball when the cap/glove is removed from the user's head. Of course, a user could also capture the ball directly toward the back 36 of the crown 12 merely by directing the ball to that portion of the crown 12. The pocket 50 will similarly receive the ball 92 and retain it in the crown interior.

The cap/glove 10 of the present invention is readily assembled of inexpensive and abundant components and provides a readily deployable glove for safely and effectively catching balls. The front access to the finger and thumb receiving slots 56, 57 facilitate quick deployment by a user. The triangular shaped flap 66, while obscuring the slots 56, 57, provides immediate access to the slots 56, 57 enhancing the ease of deployment. The elastic straps 80 cause the flap 66 to wrap around and help secure the wrist of a user to improve the retention of the cap/glove on the hand of a user when deployed as a glove while capturing a ball. The pocket 50 formed between the cap interior surface 18 and the elastic band 38 grabs a ball received in the crown interior to significantly enhance the likelihood that a ball will be retained in the crown and recovered by a user. The stitching illustrated in FIG. 8 enables the pocket to be inexpensively formed, and further makes the band readily collapse when placed on a user's head. In an alternate structure, the V-shaped plastic strips 46 are easily deformed to compress the pocket so that the cap may be comfortably worn by a user. Finally, the elastic band 38 contracts the cap opening 24 so that when a user deploys the cap/glove as a cap there is a force retaining the cap on the head. The elastic band 38 also allows the cap to accommodate different users having a variety of head sizes.

What is claimed is:

1. A combination cap/glove selectively usable as a cap worn on a person's head and a glove worn on a person's hand for catching a ball, the cap/glove comprising:

a concave crown having a peripheral bottom edge and interior and exterior surfaces;

a hand receptacle for receiving a portion of a persons hand comprising a flexible material liner attached to the interior of a first side of the crown forming a cavity between the crown interior and the liner with at least one hand appendage receiving slot which extends through the crown into the cavity; and a band of flexible sheet material having top and bottom edges, the bottom edge of the band overlying the peripheral bottom edge of the crown at a second side of the crown substantially opposite the first side of the crown and being fastened thereto and the band further including first and second ends, the band being folded into the crown interior and each of the first and second ends being fastened to the crown interior to form a ball receiving pocket between the band of material and the interior surface of the crown.

2. The cap/glove of claim 1 wherein the concave crown is formed of a flexible sheet material.

3. The cap/glove of claim 1 wherein the concave crown includes a front corresponding to the first side of the crown and a back corresponding to the second side of the crown with a brim attached to the front and extending outwardly therefrom, the band of flexible sheet material being attached to the back of the crown.

4. The cap/glove of claim 1 further comprising at least two hand appendage receiving slots which extend through the crown into the cavity for receiving opposing hand appendages.

5. The cap/glove of claim 1 further comprising a flap of flexible material on the exterior surface of the crown and means for maintaining the flap of flexible material covering the at least one hand appendage receiving slot.

6. The cap/glove of claim 5 wherein the flap of flexible material is triangular and the maintaining means comprises a permanent attachment proximate an apex of the crown at a first point of the triangle and elastic straps between second and third points of the triangle and the crown proximate the peripheral bottom edge of the crown.

7. The cap/glove of claim 6 further comprising a hook and loop fastener intermediate the second and third points of the flap between the flap and the exterior surface of the crown.

8. The cap/glove of claim 1 further comprising a pad on the interior surface of the crown for protecting portions of a hand received in the cavity when catching a ball.

9. The cap/glove of claim 1 further comprising an elastic segment attached to the exterior surface of the crown and extending across the first side of the crown below the at least one hand appendage receiving slot.

10. The cap/glove of claim 1 wherein the band of flexible sheet material comprises an elastic material and the elastic material is attached to the peripheral bottom edge of the crown in a manner biasing an effective opening of the crown defined by the peripheral bottom edge to a contracted state.

11. A combination cap/ball receptacle selectively usable as a cap worn on a person's head and as a ball receptacle for catching a ball comprising:

a concave crown formed of a flexible sheet material having a peripheral bottom edge about an opening of the crown, a front, a back, an interior surface and an exterior surface; and an elastic band having top and bottom edges attached by its bottom edge to the back peripheral bottom edge of the crown and the band further including first and second ends, the band being folded into the crown interior and each of the first and second ends being fastened to the crown interior to form a ball receiving pocket between the elastic band and the interior surface of the crown.

12. The cap/ball receptacle of claim 11 wherein the bottom edge of the band overlies the peripheral bottom edge of the crown interior.

13. The cap/ball receptacle of claim 11 further comprising a hand receptacle formed in part by the front of the crown for receiving a portion of a person's hand comprising a flexible material liner attached to the interior of the crown forming a cavity between the crown interior and the liner and at least one hand appendage receiving slot which extends through the crown into the cavity.

14. The cap/ball receptacle of claim 13 wherein the band receptacle has at least two hand appendage receiving slots which extend through the crown for receiving opposing hand appendages.

15. The cap/glove of claim 13 further comprising a triangular flap of flexible material on the exterior surface of the crown covering the at least one slot, a permanent attachment proximate an apex of the crown at a first point of the triangle and elastic straps between second and third points of the triangle and the crown prosimate the peripheral bottom edge of the crown.

16. A combination cap/glove selectively usable as a cap worn on a person's head and a glove worn on a person's hand for catching a ball comprising:

a concave crown formed of a flexible sheet material having a peripheral bottom edge about an opening of the crown, a front, a back, an interior surface and an exterior surface;

a flexible material liner attached to the interior of the crown forming a cavity between the crown interior and the liner and at least one hand appendage receiving slot which extends through the crown between the peripheral edge of the crown and an apex of the crown, whereby with a person's hand appendage received in the slot the glove may be directed by a person's hand to catch a ball;

a flap of flexible material on the exterior surface of the crown; and means for maintaining the flap of flexible material covering the at least one slot.

17. The cap/glove of claim 16 wherein the flap of flexible material is triangular and the maintaining means comprises a permanent attachment proximate an apex of the crown at a first point of the triangle and elastic straps between second and third points of the triangle and the crown proximate the peripheral bottm edge of the crown.

* * * * *